United States Patent [19]

Grout

[11] Patent Number: 4,850,563

[45] Date of Patent: Jul. 25, 1989

[54] ADJUSTABLE DESK FRAME

[75] Inventor: John E. Grout, Castlecrag, Australia

[73] Assignee: Ergonomic Equipment Pty. Ltd., Marrickville, Australia

[21] Appl. No.: 58,177

[22] Filed: Jun. 4, 1987

[51] Int. Cl.[4] ..... A47B 9/00

[52] U.S. Cl. ..... 248/422; 248/188.5; 74/89.14; 108/147

[58] Field of Search ..... 248/422, 404, 188.2, 248/188.5; 108/147; 297/348; 74/89.14, 425; D6/491

[56] References Cited

U.S. PATENT DOCUMENTS

| | | | |
|---|---|---|---|
| 732,436 | 6/1903 | Owens | 74/425 X |
| 1,915,802 | 6/1933 | Roshnell | 108/147 X |
| 1,957,785 | 5/1934 | Knapp | 248/422 |
| 2,829,928 | 4/1958 | Callaway | 108/147 |
| 3,140,559 | 7/1964 | Crow et al. | 108/147 |
| 4,151,804 | 5/1979 | Wache et al. . | |
| 4,515,087 | 5/1985 | Kurrasch . | |
| 4,627,364 | 12/1986 | Klein et al. | 248/422 |

FOREIGN PATENT DOCUMENTS

| | | | |
|---|---|---|---|
| 246818 | 10/1962 | Australia . | |
| 225350 | 9/1910 | Fed. Rep. of Germany | 108/147 |
| 2171597 | 9/1986 | United Kingdom . | |

*Primary Examiner*—Alvin C. Chin-Shue
*Attorney, Agent, or Firm*—Ladas & Parry

[57] ABSTRACT

A desk frame including a base consisting of a pair of vertically extending transversely spaced members, a sub-frame vertically movably adjustably supported by the base, and including a pair of vertically extending members telescopically received within the vertical members of the base, a drive assembly to move the subframe vertically relative to the base, the drive assembly including a rack gear attached to each vertical member of the sub-frame, a pinion gear meshingly engaged with each rack, with the pinion gears being rotatably supported by the base, a shaft extending between the two pinions to transmit rotary power therebetween, a worm gear meshingly engaged with one of the pinions, and rotatably supported by the base, a drive shaft fixed to the worm gear and extending therefrom to a position manually operable by a user of the desk, and wherein the drive shaft is also adapted to be supported by the sub-frame.

7 Claims, 15 Drawing Sheets

ADJUSTABLE DESK FRAME

The present invention relates to desk frames and more particularly to an adjustable frame to vertically position the desk work surface.

Conventional desk frames have the disadvantage that the means of adjusting the height of the top work surface has included a drive system movable vertically with the work surface. When the desk frame is being transported, it is obviously an advantage to have the frame occupy a minimum space. In order to achieve this, the drive mechanism needs to be dismantled with respect to the base frame since the desk top is removed. Accordingly, at the point of use of the desk frame, the frame needs considerable work in respect of reconstruction.

It is the object of the present invention to overcome or substantially ameliorate the above disadvantages.

There is disclosed herein a frame to support a work surface, said frame comprising a base to rest upon a floor, a sub-frame movably supported by said base, said base and sub-frame having co-operating guide means to restrain the sub-frame to move vertically relative to said base, and manually operable means to move said sub-frame vertically relative to said base, said manually operable means including a rack attached to said sub-frame, and a manually driven pinion meshingly engaged with said rack so that upon rotation of said pinion, said rack is caused to move said sub-frame vertically and wherein said pinion is mounted on said base.

There is further disclosed herein a frame to support a work surface, said frame comprising a base to rest upon a floor, said base including a pair of vertical members which are generally parallel and co-extensive; a sub-frame vertically adjustably supported by the base, said sub-frame including a pair of vertical members guidably supported by the phase vertical members, the sub-frame vertical members being generally parallel and co-extensive; and a manually driven drive assembly to move the sub-frame vertically relative to the base, said drive assembly including a rack gear fixed to one of said sub-frame vertical members so as to extend vertically therealong, a pinion gear rotatably supported by said base so as to be rotatably about an axis transverse of the base vertical members and engaging said rack gear so as to drive the rack gear, a worn gear rotatably supported by the base and meshingly engaged with the pinion gear so as to be rotatably about an axis normal to the axis of the pinion ngear, a drive shaft having a longitudinal axis co-axial with the axis of the worm gear and drivingly fixed thereto, and wherein said drive shaft is adapted to extend from the worm gear to a position manually rotatably by a user of the work surface, and is adapted to be supported by the sub-frame when the frame is assembled, while being rotatable about the axis of the pinion to a transport position located adjacent the base vertical members.

A preferred form of the present invention will now be described by way of example with reference to the accompanying drawings, wherein.

Figure 1:
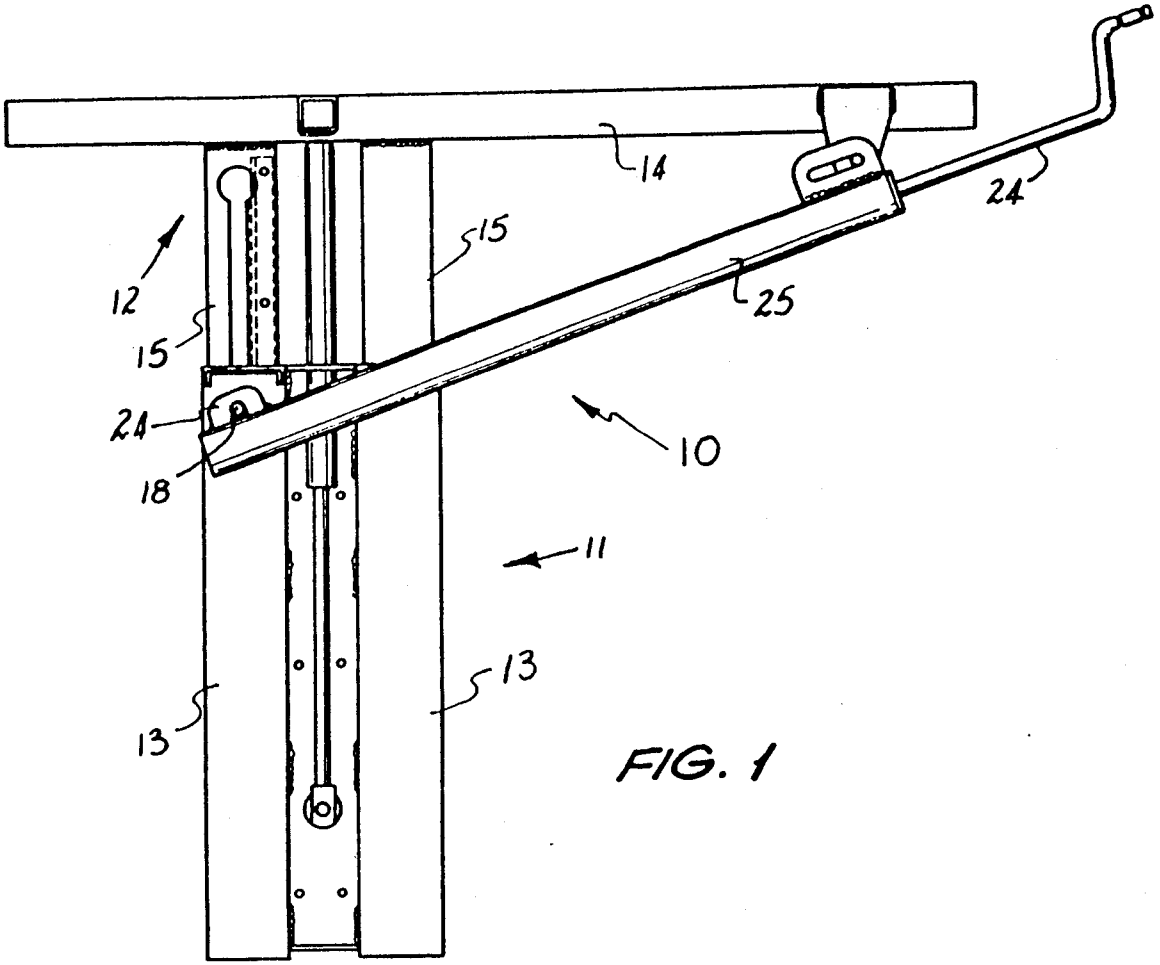
FIG. 1 is a schematic side elevation of an adjustable desk frame.

In FIG. 1 there is schematically depicted an adjustable desk frame 10 having a floor engaging base 11 and a vertically movable sub-frame 12. The sub-frame 12 and base 11 have co-operating channel surfaces which slideably guide movement of the sub-frame 12 relative to the base 11. The sub-frame 12 is provided with horizontal members 14 to support desk top 82 affixed to two vertical members 15 which slidably engage two channel portions 13 of the base 11 so as to be slidably guided thereby. More particularly, the vertical members 15 are formed of square tubing together with the portions 13 within which the vertical members 15 are telescopically located. It would also be preferable to provide caged needle rollers in sets so as to rigidly accurately guide the vertical members 15 in their movement relative to the base 11. It should also be noted that each side of the desk frame 10 is provided with its respective portios 13 and vertical members 15. Extending between the two dies of the adjustable frame 10 are braces 16 and 17, together with a drive shaft 18 supported by the sub-frame 12. On each side of the adjustable frame 10, there is provided a rack 19 fixed to one of the vertical members 15. The extremities of the drive shaft 18 are each provided with a pinion 20 meshingly engaged with the rack so that upon rotation of the drive shaft 18 the sub-frame 12 is caused to move vertically.

Fixed to the drive shaft 18 is a driven gear 21 meshingly engaged with a worm gear 22 driven by meansn of a further drive shaft 23 extending to adjacent the upper portion of the sub-frame 12. The extremity of the shaft 23 is provided with a retractable handle 24. Upon rotation of the handle 24, the shaft 23 drives the worm gear 22 to cause rotation of the gear 21 and subsequently the shaft 18. The shaft 23 and its associated worm gear 22 are mounted in a housing 25 rotatably supported on the shaft 18. Additionally, the housing 25 has one end pivotally supported on an extremity of the sub-frame 12.

Figure 2:
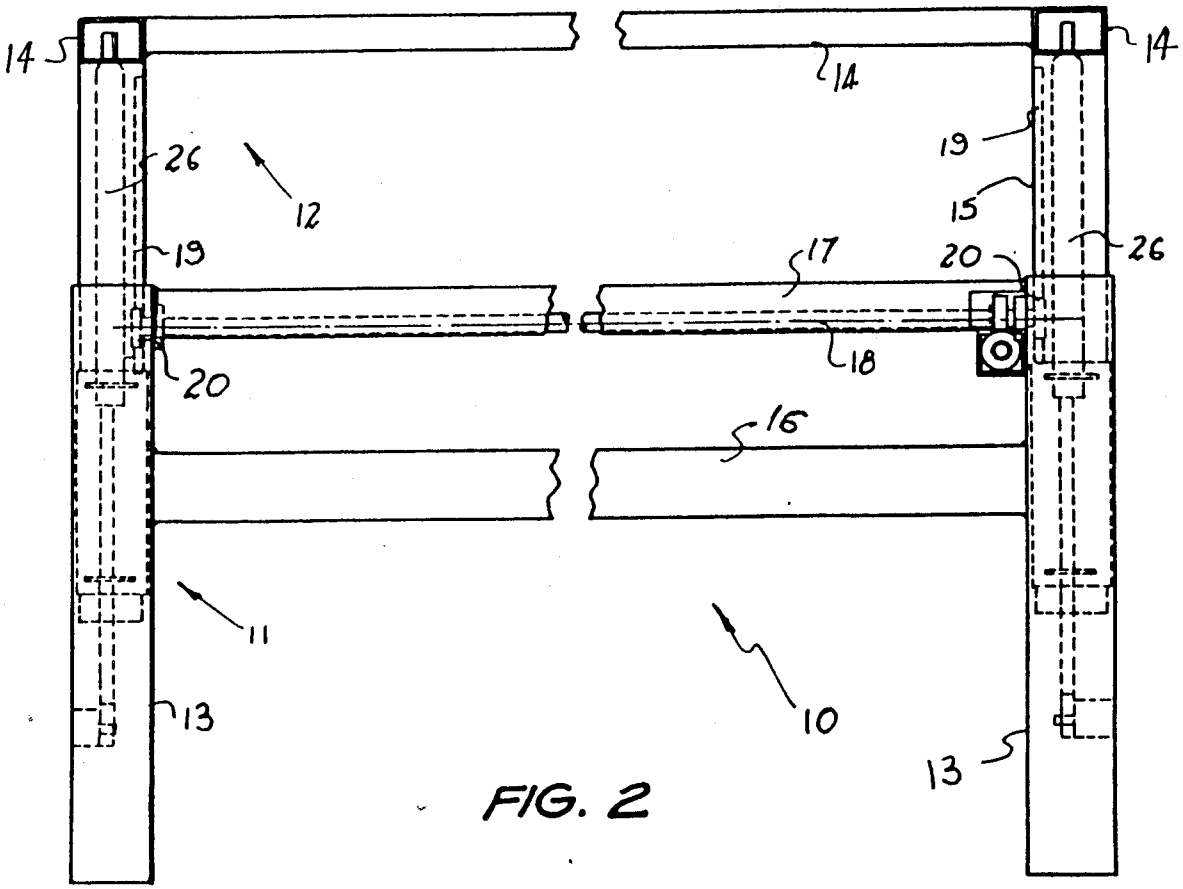
FIG. 2 is a schematic end elevation of the frame of FIG. 1.

Now with particular reference to FIG. 2 wherein the sub-frame 12 is schematically depicted as supported by the base 13. Extending between the base 13 and sub-frame 12 are two "gas-struts" 26 located within the frame portions 13, and between the members 15. THe gas struts 26 at least partly support the sub-frame 12 and its associated work top. This thereby produces the effort required by the operator to raise and lower the work top.

Figure 3:
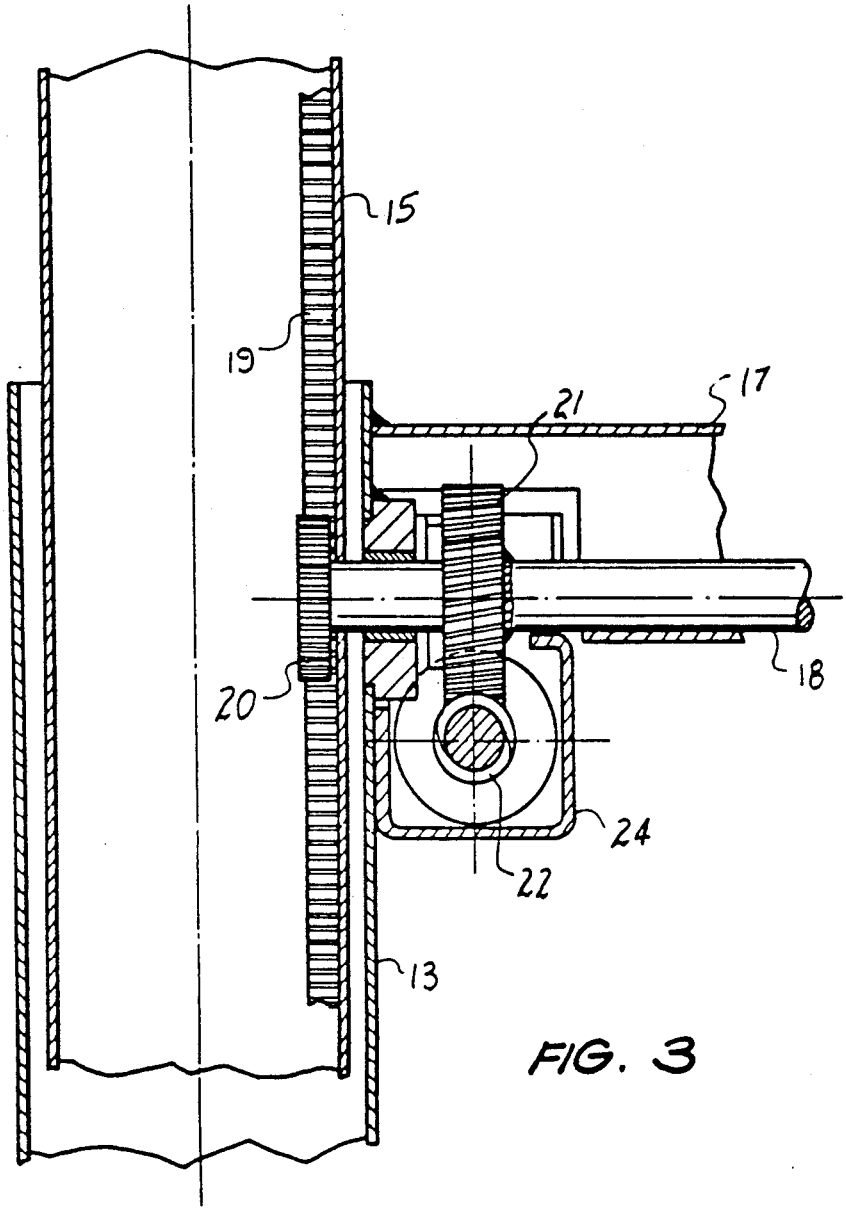
FIG. 3 is a schematic part sectioned portion of a drive mechanism to adjust the height of the frame of FIGS. 1 and 2.
Figure 4:
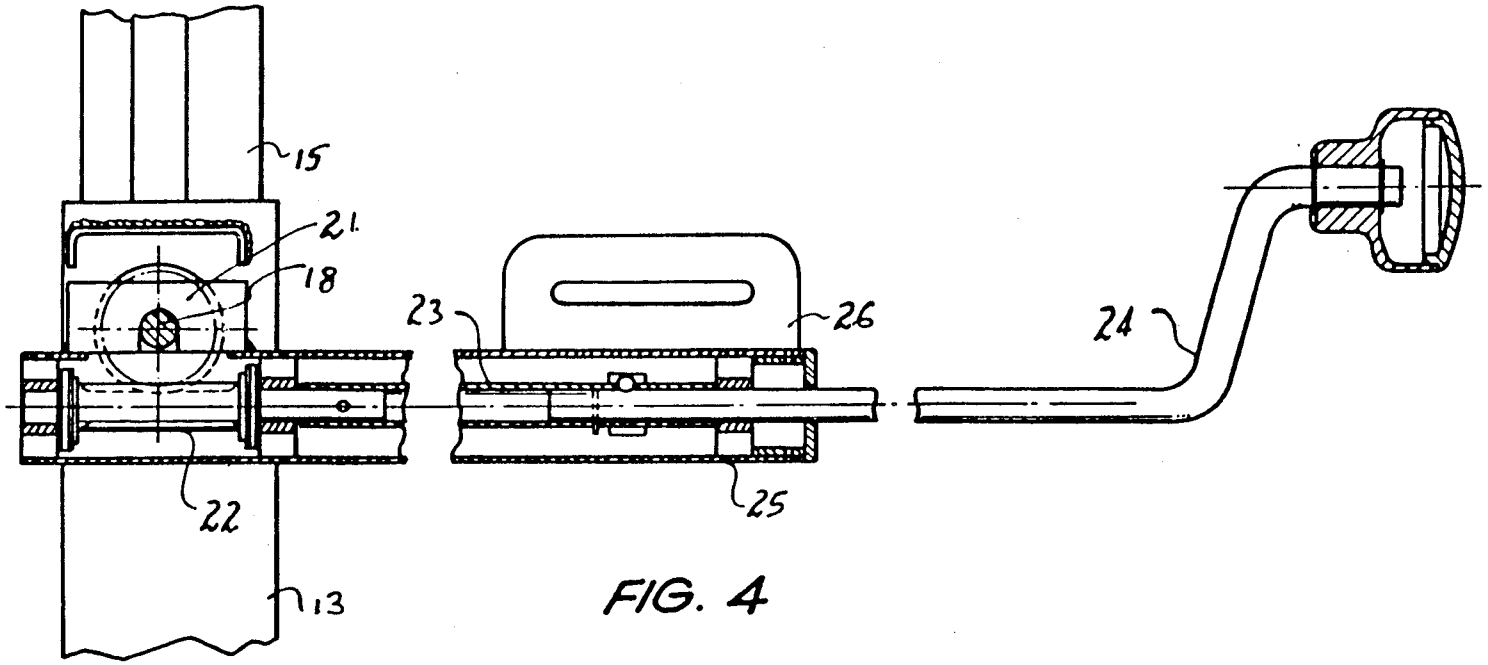
FIG. 4 is a schematic sectioned side elevation of the drive mechanism of FIG. 3.
Figure 5:
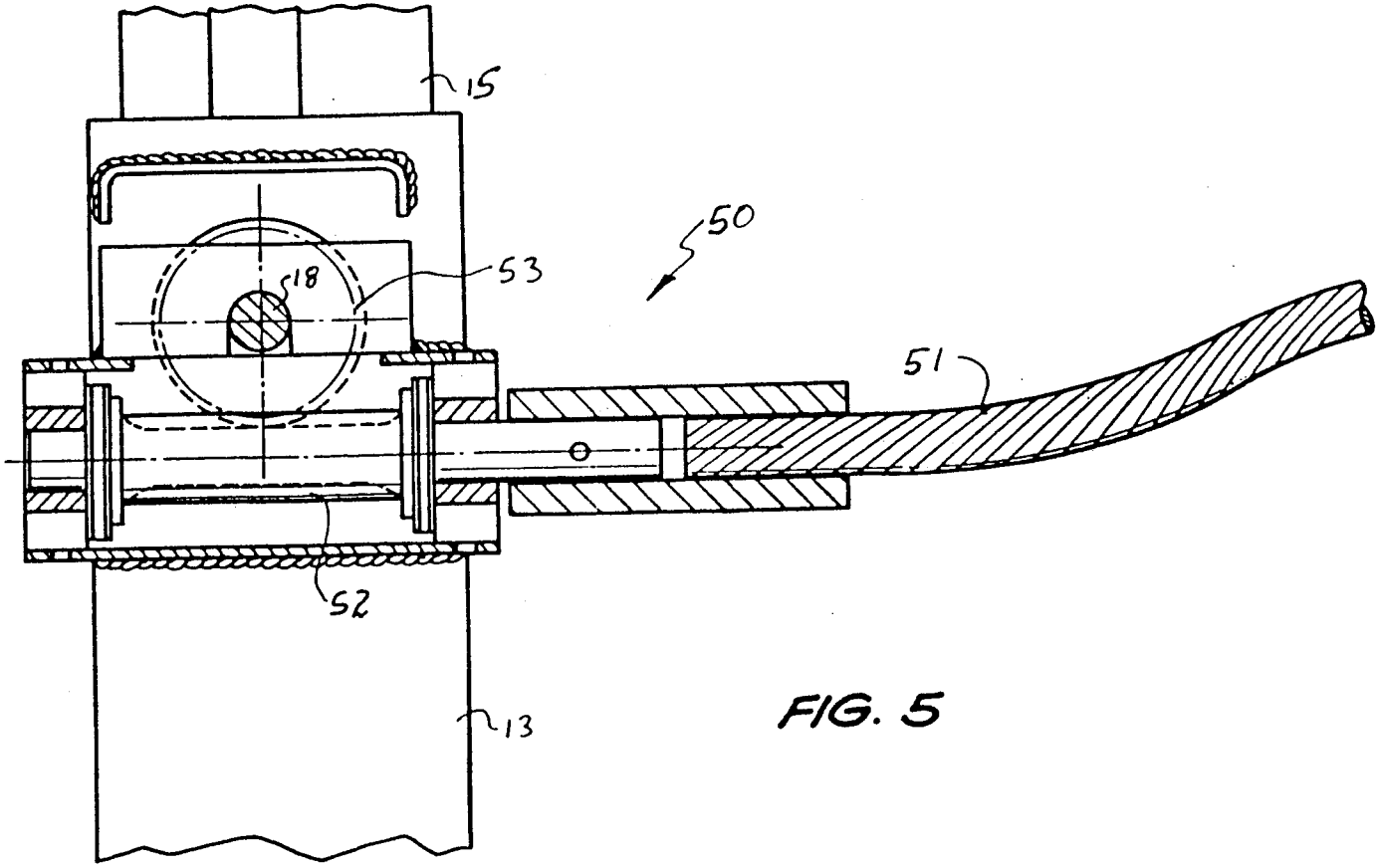
FIG. 5 is a schematic sectioned side elevation of an alternative drive assembly to be employed with the frame of FIGS. 1 to 4.

In FIG. 5 there is schematically depicted an alternative drive for the desk frame 10 of FIGS. 1 to 3. In FIG. 5 there is schematically depicted a drive assembly 50 to move the vertical member 15 relative to the channel portion 13. The drive assembly 50 includes a flexible drive element 51 which extends to a similar handle to that as depicted in FIG. 1. That is, the flexible drive element 51 replaces the housing 25 and its associated shaft 23. The flexible drive element 51 is drivingly associated with a worm gear 52 meshingly engaged with a pinion gear 53 which drives the shaft 18. Accordingly, as the working surface of the desk is raised and lowered, the flexible drive element 51 accommodates relative movement between the handle and the drive assembly 50.

Figure 6:
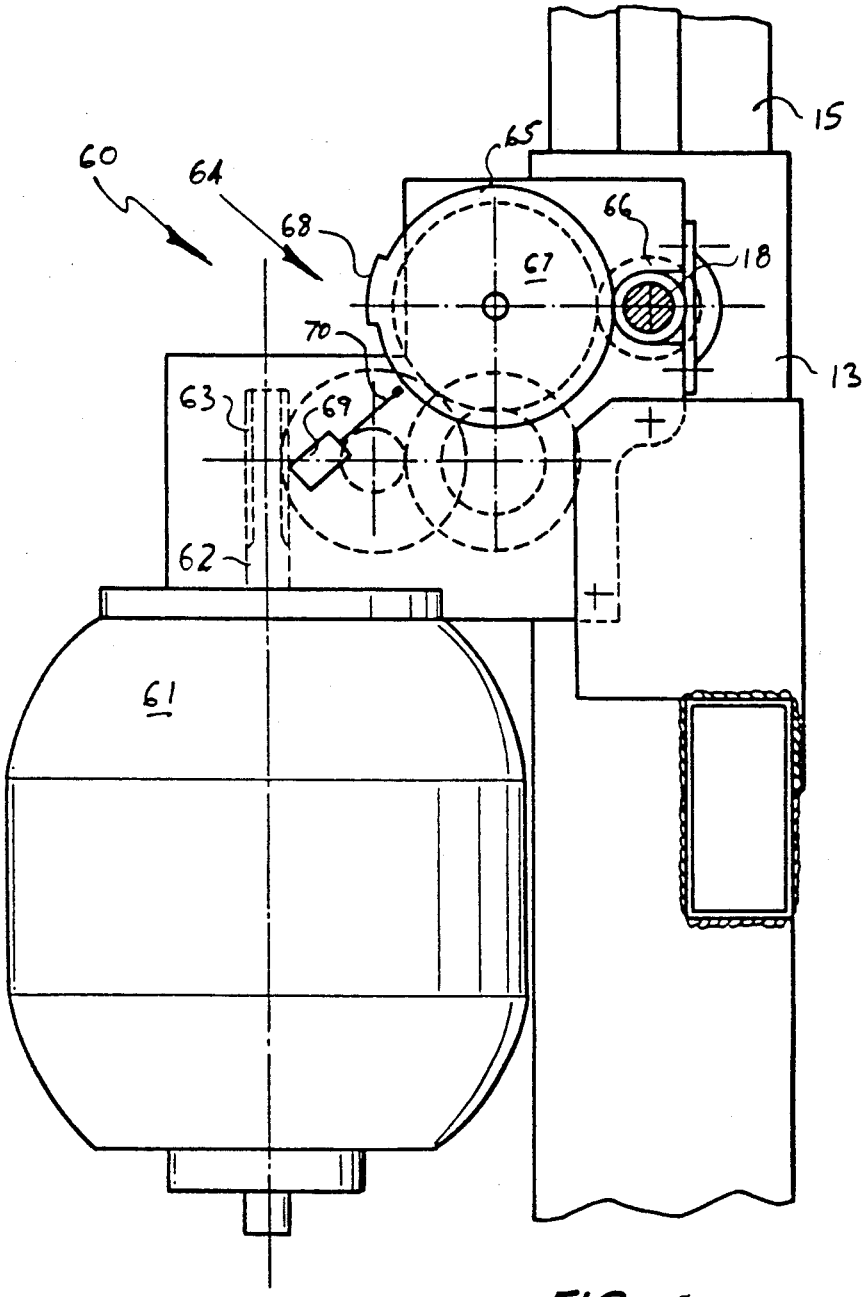
FIG. 6 is a schematic side elevation of an electric drive assembly for the frame of FIG. 1.
Figure 7:
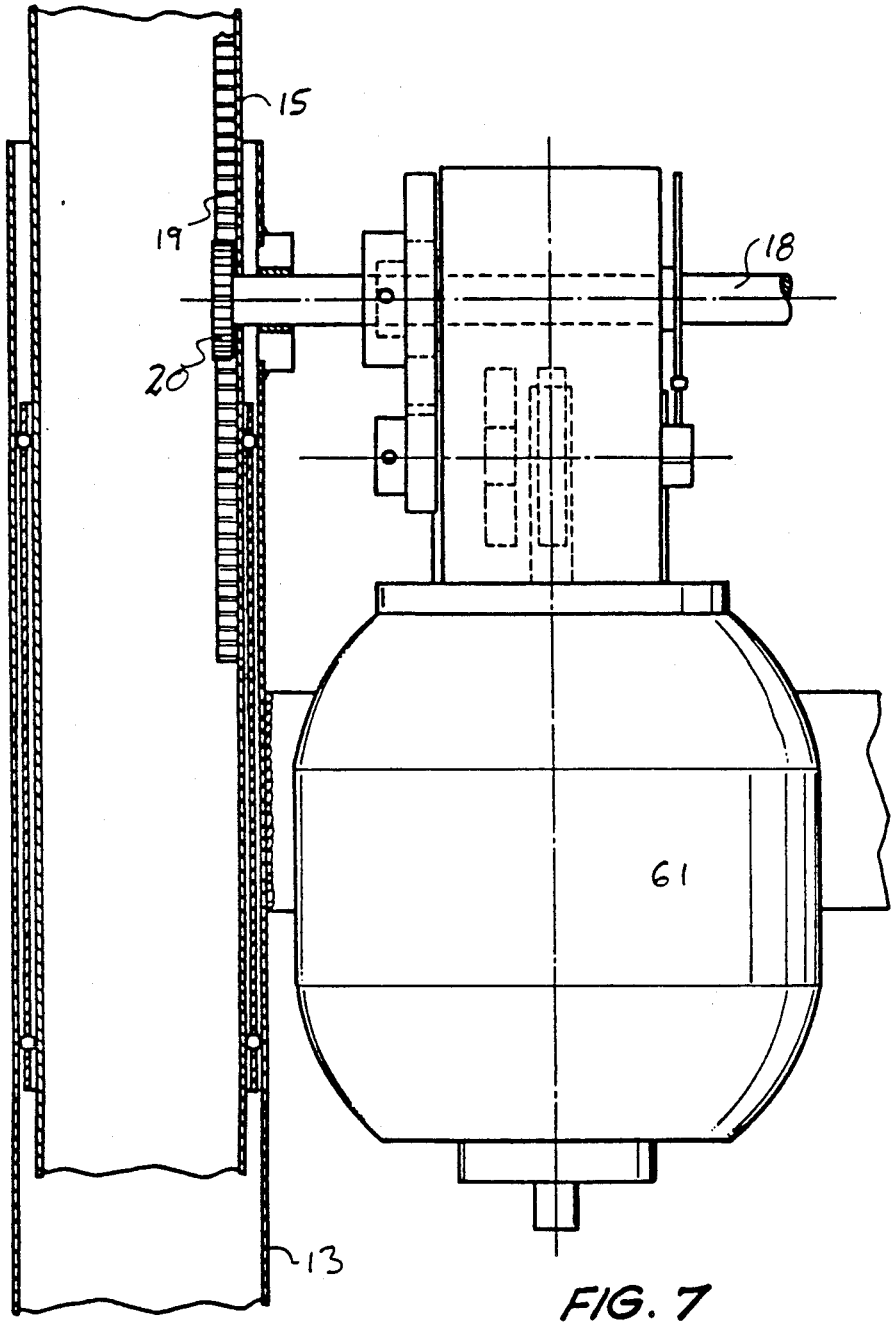
FIG. 7 is a schematic end elevation of the drive assembly of FIG. 6.

In FIGS. 6 and 7 a still further drive assembly 60 is depicted. The drive assembly 60 vertically moves the member 15 relative to the channel portion 13. Again, a driven shaft 18 is provided in a similar manner to the desk frame 10 of FIGS. 1 to 4.

The drive assembly 60 includes an electronically controlled electric motor 61 having an output shaft 62 with a worm gear 63. The worm gear 63 meshingly engages a gear train 64 having an output gear 65 meshingly engaged with a gear 66 fixed to the shaft 18. Attached to the same shaft as the gear 65 is a cam member 67 having a cam projection 68 which engages a switch 69 to limit movement of the member 15 relative to the channel portion 13. The switch 69 has a flexible arm 70 which engages the cam projection 68.

Figure 8:
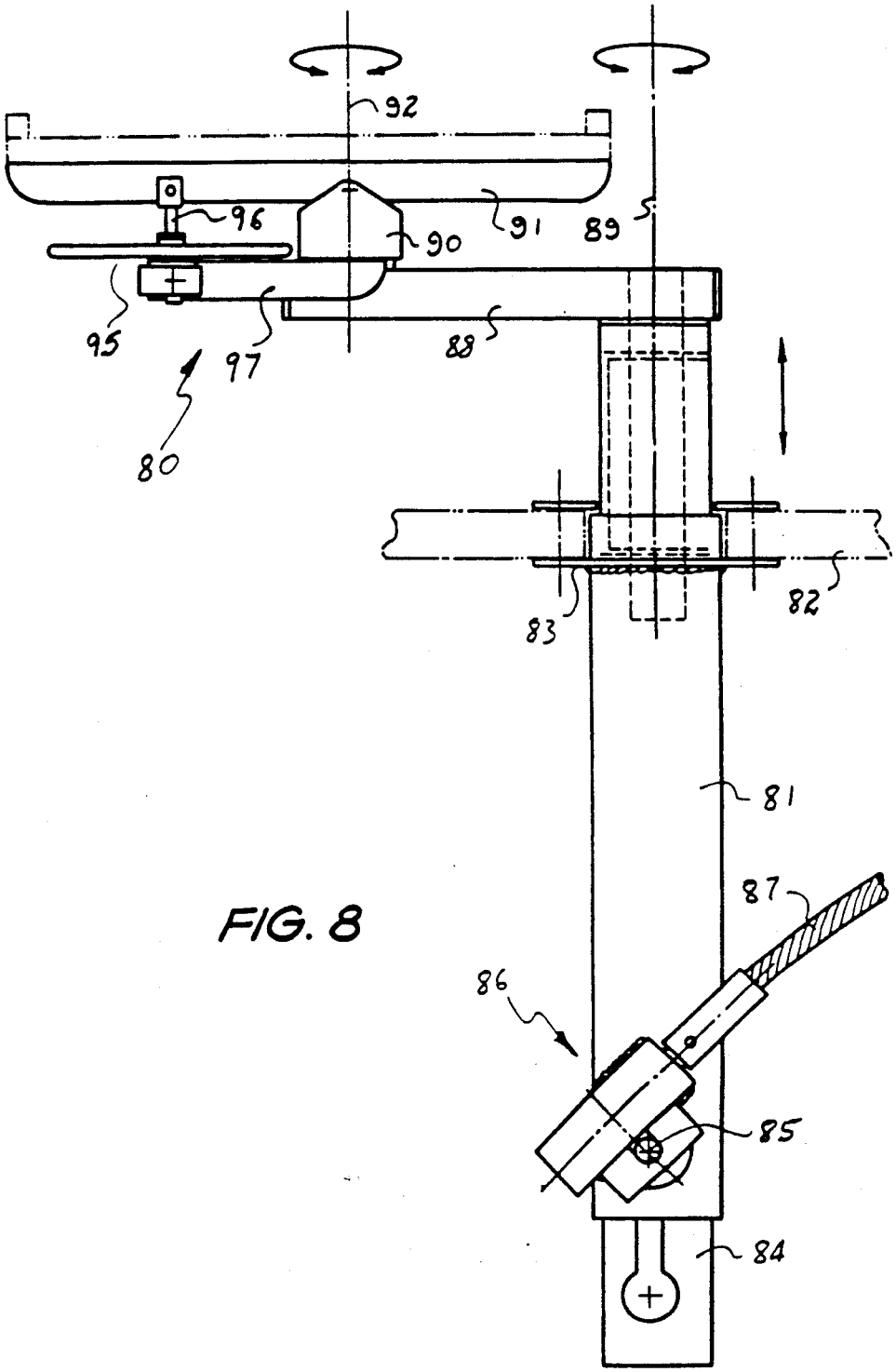
FIG. 8 is a schematic front elevation of a "VDU" screen support to be used with the frame of FIG. 1.
Figure 9:
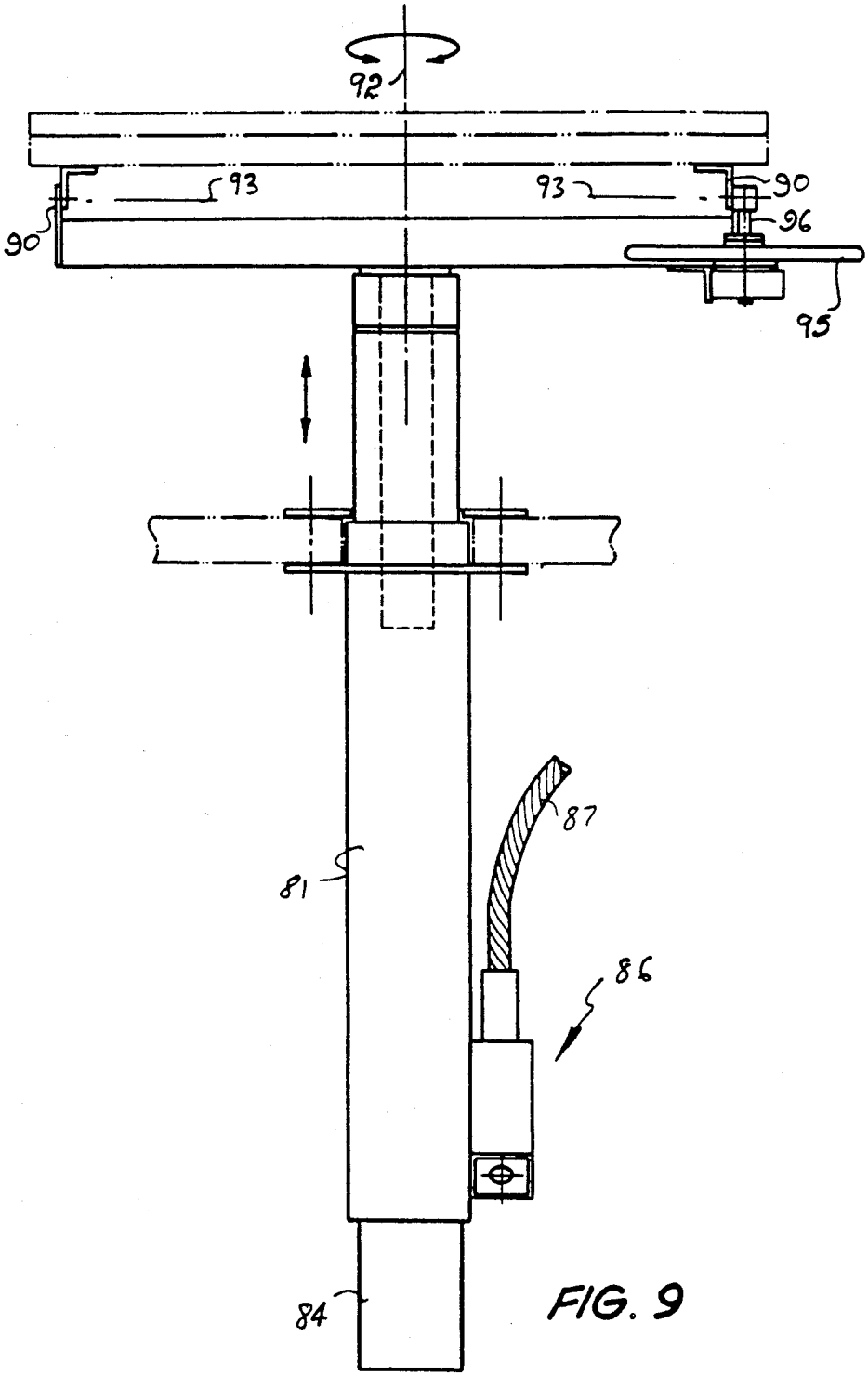
FIG. 9 is a schematic side elevation of the screen support of FIG. 8.

In FIG. 8 there is schematically depicted a "VDU" screen support assembly 80 which may be used in conjunction with the desk frame 10 and its associated drive mechanisms previously described. The assembly 80 includes a base member 81 of tubular form fixed to the desk top 82. The base 81 projects through the top 82 and is secured thereto by flanged mounting member 83. Telescopically located within the base 81 is a mounting member 84 is which there is attached a rack as used in the drive mechanisms associated with the desk frame 10. The rack is driven by means of pinion fixed to a driven shaft 85. The shaft 85 is driven via a drive assembly 86 of similar construction of the drive assembly 50 of FIG. 5, in that a flexible drive element 87 is provided. At the top end of the mounting member 84 there is provided an arm 88 rotatably supported so as to be rotatably about the axis 89. One end of the arm 88 is provided with a mounting 90 which engages a support member 91 so that the support member 91 is rotatable about the axis 92. Additionally, the support member 91 is rotatably about the axis 93. More particularly, an adjustment assembly 94 is provided which adjustably tilts the support member 91 about the axis 93. The adjustment assembly 94 includes an adjustment wheel 95 which is fixed to a drive nut which engages a threaded shaft 96. The adjustment wheel 95, and its associated drive nut, is fixed to an arm 97 extnding from the arm 88.

As can be seen from the above, the height of the VDU screen can be adjusted via operation of the drive assembly 86. Therefore the VDU screen can be positioned as required by rotation of the arm 88 about the axis 89, the mounting 90 about the axis 92 andn tilting of the support 91 about the axis 93.

Figure 10:
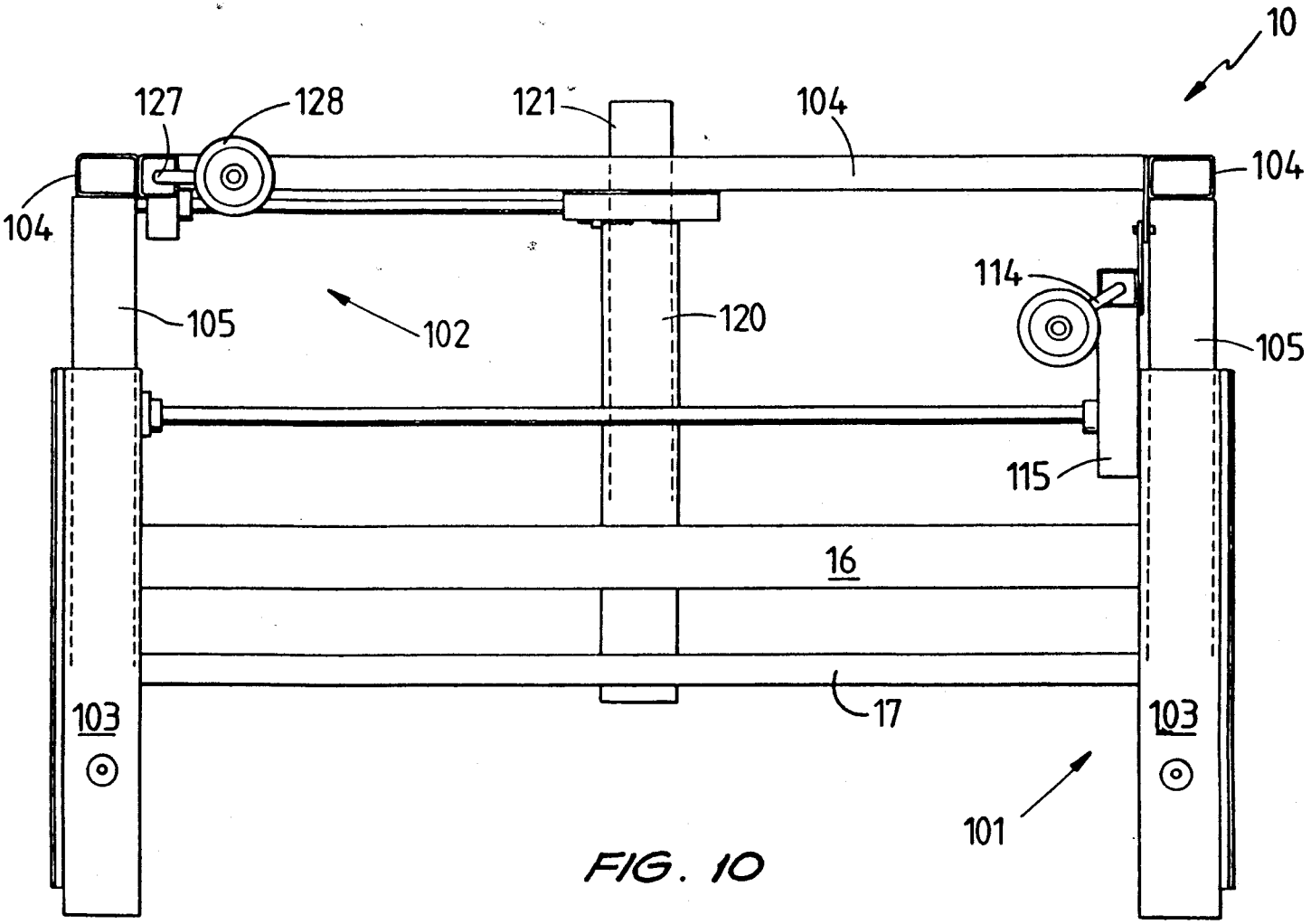
FIG. 10 is a schematic front elevation of a further desk frame to that shown in FIG. 1.
Figure 11:
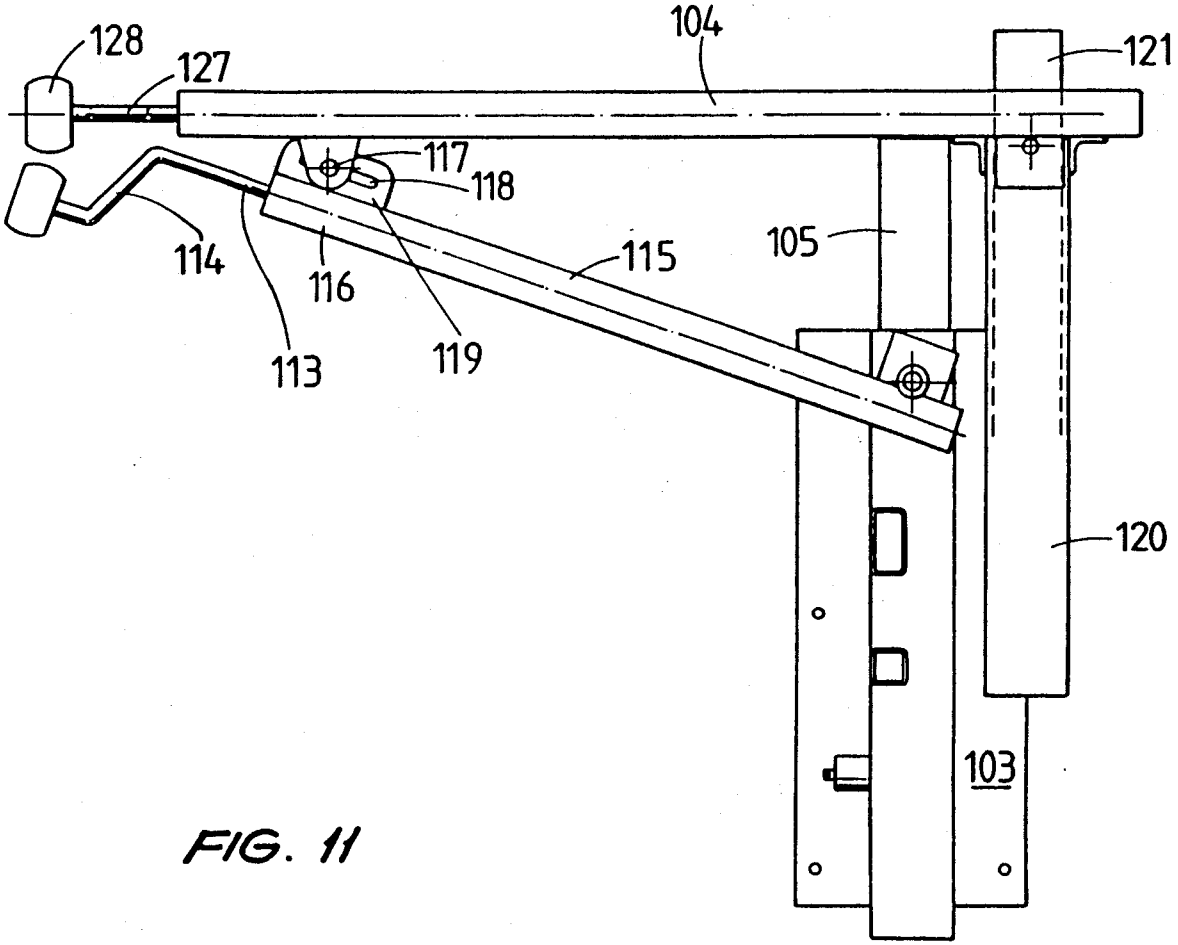
FIG. 11 is a schematic side elevation of the desk frame of FIG. 10.

In FIG. 10 there is schematically depicted a desk frame 100 having a floor engaging base 101 and a vertically movable sub-frame 102, vertically adjustable relative to the base 101. The sub-frame 102 is provided with horizontal members 104 to support a desk top. The members 104 are fixed to two vertical members 105 which are slidably received within two channel portions 103 of the base 101. The vertical members 105 are formed of tubing which co-operate in transverse cross section, with portions 103 within which the vertical members 105 are telescopically associated. Extending between the vertical members 103 are horizontal braces 16 and 17, while extending between the vertical members 105, is one of the horizontal members 104, and a drive shaft 108.

Each extremity of the drive shaft 108 is provided with a pinion gear 110, meshingly engaged with the associated rack 109. The shaft 108 has fixed to it a gear 111 meshingly engaged with a worm gear 112 driven by means of a further drive shaft 113 extending to adjacent the upper portion of the sub-frame 102. The extremity of the shaft 113 is provided with a retractable handle 114. Upon rotation of the handle 114, the shaft 1113 drives the worm gear 112, to cause rotation of the gear 111 and subsequently the shaft 108. The shaft 113 and its associated worm gear 112 are mounted in a housing 115 rotatably supported on the shaft 108. Additionally, the housing 115 has its end 116 pivotally supported by means of a pin 117 slidably received within a slot 118 formed in a bracket 119 fixed to the housing 116. Accordingly, the housing 116, and therefore the shaft 113, can pivot about the shaft 108 and pin 117, while still accommodating for a variation in the distance between the shaft 108 and pin 117, due to vertical height adjustment of the sub-frame 102.

Fixed to the two transverse horizontal members 104 is a vertical support member 120 to receive a vertically adjustable mast 121 of a "VDU" support, as shown in FIG. 8. This port 120 telescopically receives the mast 121, while fixed to the mast 121 is a gear rack 122 meshingly engaged with a pinion 123. The pinion 123 is rotatably supported by means of a bearing assembly 124, and is driven by means of a shaft 125 provided with a gear 126. The gear 126 is rotatably driven by means of a worm gear, which in turn is driven by means of a shaft 127 having a handle 128.

Figure 12:
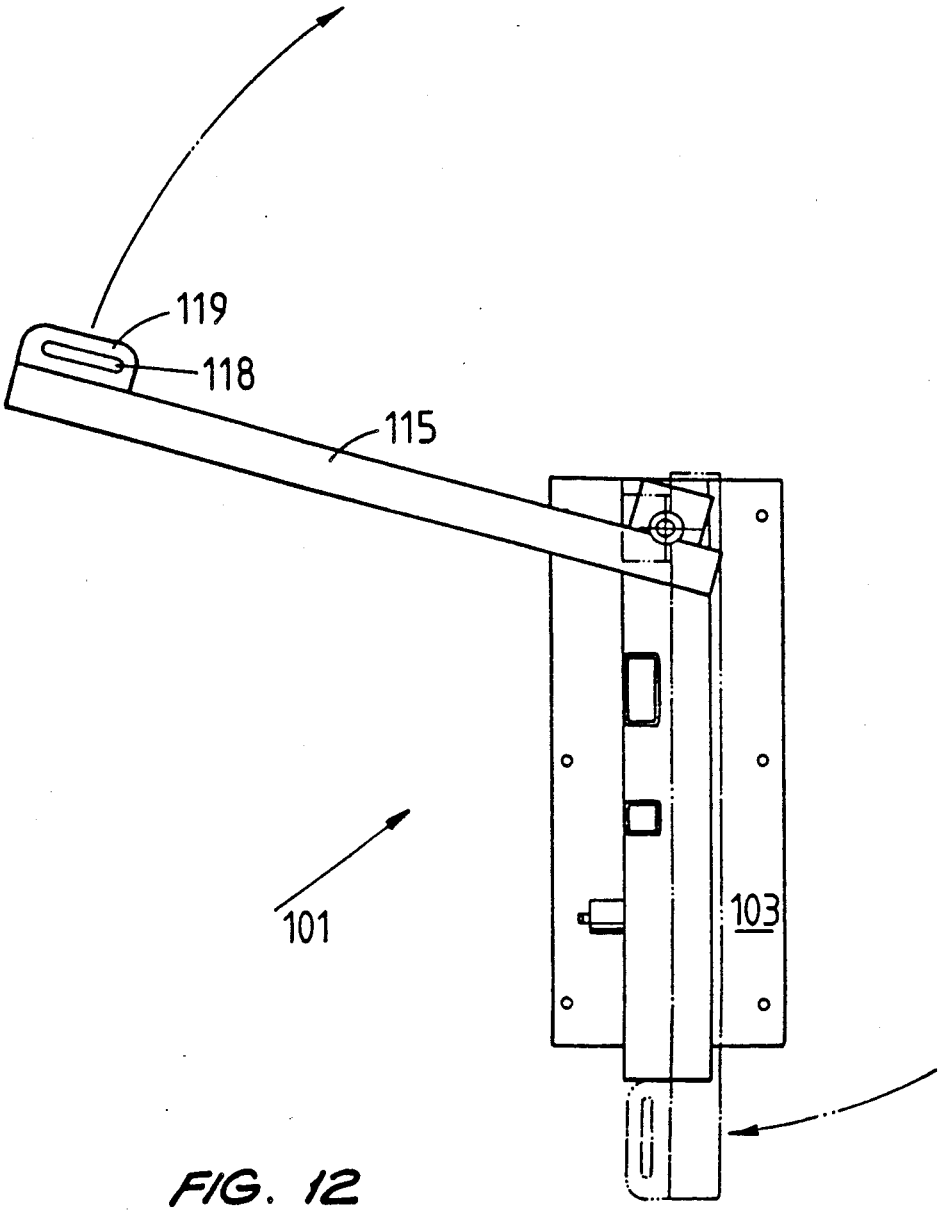
FIG. 12 is a schematic side elevation of the desk frame of FIG. 10 in a folded mode for transportation.
Figure 13:
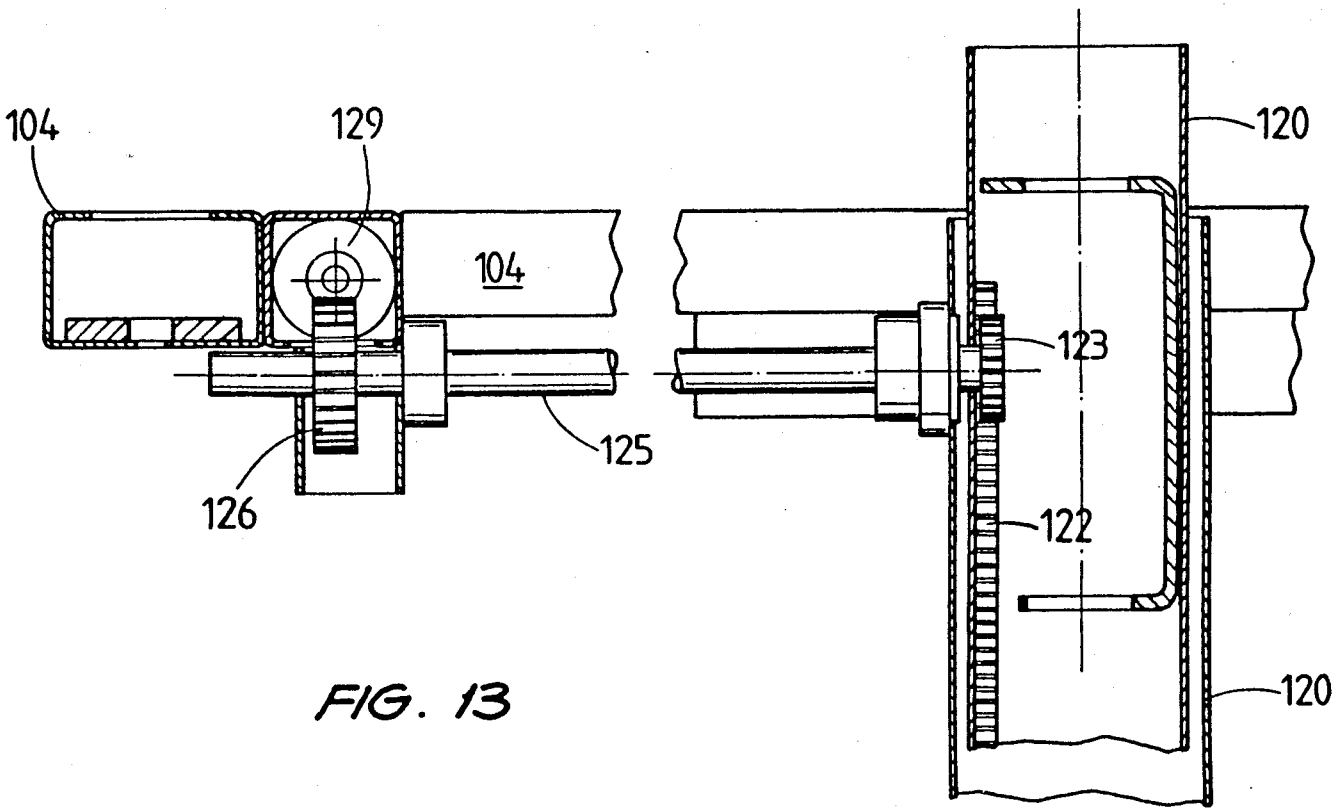
FIG. 13 is a schematic part sectioned side elevation of a portion of the frame of FIG. 10.
Figure 14:
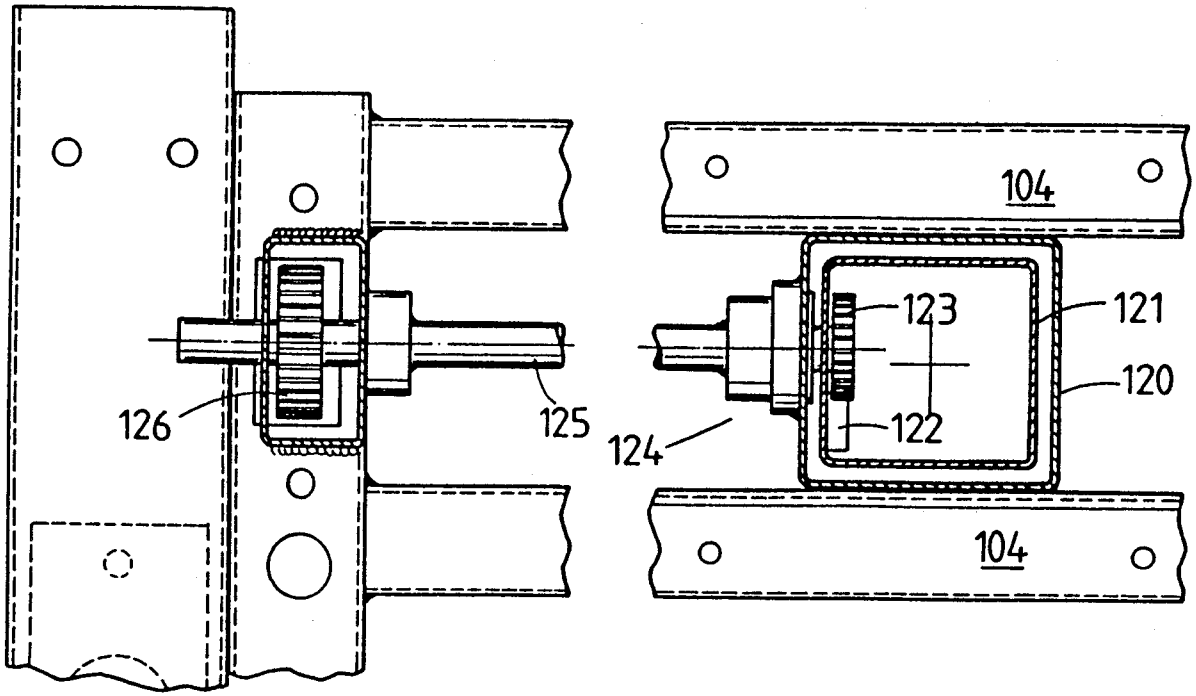
FIG. 14 is a schematic part sectioned plan view of a portion of the desk frame of FIG. 10.
Figure 15:
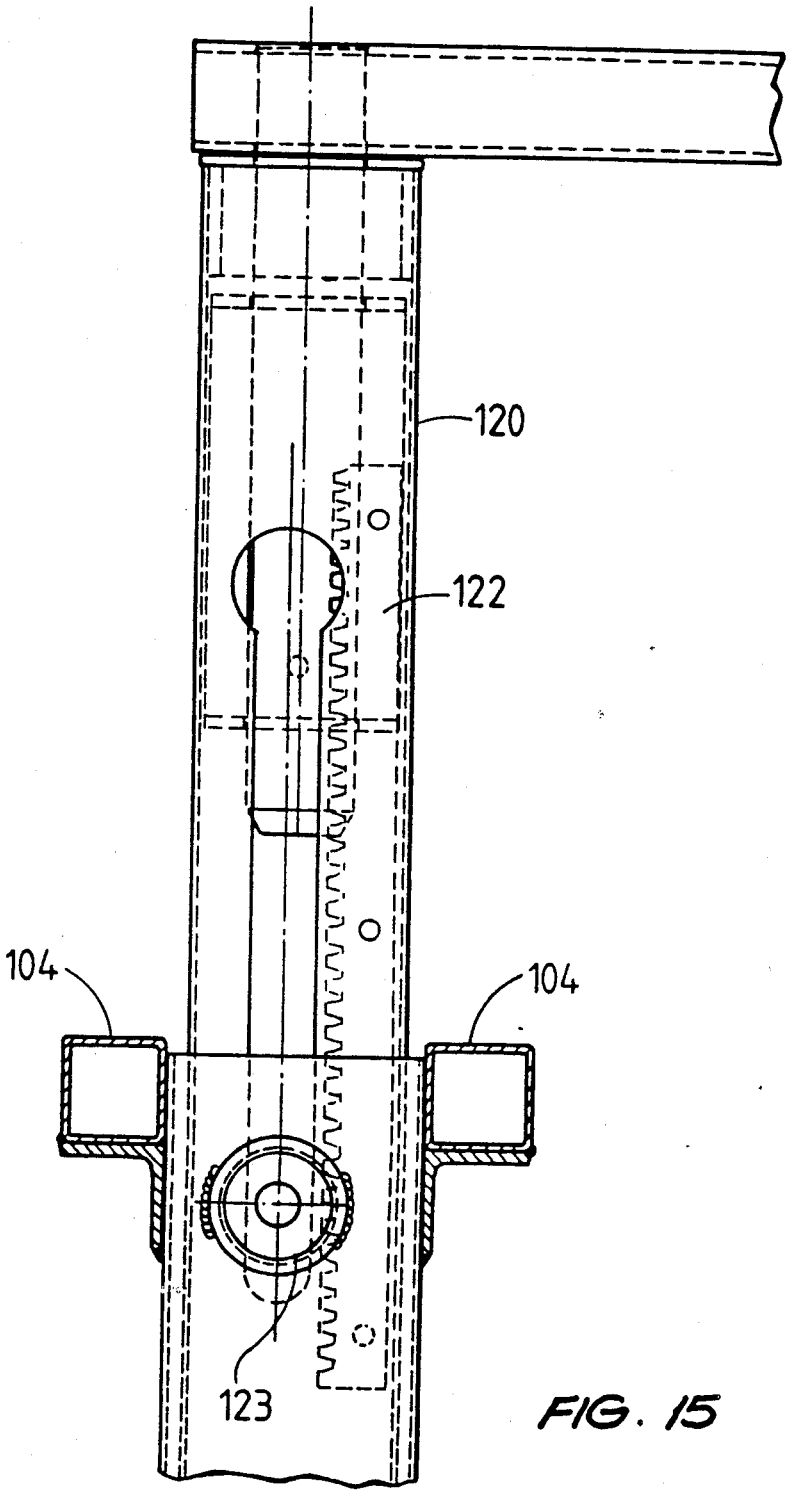
FIG. 15 is a schematic part sectioned side elevation of the desk frame portion of FIG. 14.

For transportation purposes, the horizontal members 104, and the VDU support member 120, and its associated mast 121, and drive assembly are detachable as a unit, in combination with the vertical members 105, from the base 101. This is achieved by removing the pin 117 from within the slot 118 and removing the vertical members 105 from within telescopic engagement with the vertical members 103. Thereafter, the housing 115, and the drive mechanisms supported thereby, can be pivoted to a position as depicted by the "ghost" lines shown in FIG. 12. This greatly reduces the volume occupied by the base frame 101, and therefore the total volume occupied by the desk 10 for transportion purposes.

To re-assemble the desk 100, the members 105 are merely inserted into the members 103, and the pin 117 inserted in the slot 118.

What I claim is:

1. A frame to support a work surface, said frame comprising a base to rest upon a floor, said base including a pair of vertical members which are generally parallel and coextensive; extensive;

a sub-frame vertically adjustably supported by the base, said sub-frame including a pair of vertical members guidably supported by the base vertical members, the sub-frame vertical members being generally parallel and co-extensive; and a manually driven drive assembly to move the sub-frame vertically relative to the base, said drive assembly including a rack gear fixed to one of said sub-frame vertical mlembers so as to extend vertically therealong, a pinion gear having a shaft and rotatably supported by said base so as to be rotatable about an axis transverse of the base vertical members and said pinion gear engaging said rack gear so as to drive the rack gear, a worm gear rotatably supported by the base and meshsingly engaged with a driven gear fixed to said shaft so as to be rotatable abou an axis normal to the axis of the pinion gear, a drive shaft having a longitudinal axis co-axial with the axis of the worm gear and drivingly fixed thereto, said drive shaft being pivotally attached to both said base and subframe, and wherein said drive shaft extends from teh worm gear to a position by thew ork surface that is manually rotatable by a user of the work surface, while being rotatable about the axis of the pinion to a transport position located adjacent the base vertical members.

2. The frame of claim 1, wherein said sub-frame vertical members are telescopically received withins aid base vertical members.

3. The frame of claim 2, wherein said drive assembly further includes a further rack gear attached to the other sub-frame vertical member, a further piniong ear meshingly engaged with the further rack gear and rotatably supported by the base, and a shaft extending between the two pinions nso as to transfer rotary power therebetween.

4. The frame of claim 3, wherein said drive assembly further includes a housing encompassing said worm gear and drive shaft, said housing including a pivot assembly to pivottally attach the housing to said sub-frame when the frame is assembled.

5. The frame of claim 4, wherein said pivot assembly includes a slot fixed to said housing, and a pin fixed to said sub-frame and slidingly received within said slot so that said housing can pivot about said pin while said pin is free to slide along said slot.

6. The frame according to claim 1, wherein a resistance means is attachable to the base and sub-frame, said resistance means resists the raising and lowering of the work surface.

7. The frame according to claim 6, wherein the resistance means consists of at least two gas struts.

* * * * *